United States Patent [19]

Hansen

[11] 3,932,116

[45] Jan. 13, 1976

[54] METHOD AND APPARATUS FOR BURNING PULVERULENT MATERIALS

[75] Inventor: Dan S. Hansen, Copenhagen Valby, Denmark

[73] Assignee: F. L. Smidth & Co., Cresskill, N.J.

[22] Filed: July 24, 1974

[21] Appl. No.: 491,603

[30] Foreign Application Priority Data

July 31, 1973 United Kingdom ..... 36377/73

[52] U.S. Cl. ..... 432/14; 432/80; 432/106

[51] Int. Cl.[2] ..... F27B 15/00; F27B 7/02

[58] Field of Search ..... 432/14, 15, 80, 106

[56] References Cited

UNITED STATES PATENTS

| | | | |
|---|---|---|---|
| 1,468,168 | 9/1923 | Pike | 432/80 |
| 1,929,953 | 10/1933 | Lindhard | 432/106 |
| 2,283,129 | 5/1942 | Roubal | 432/80 |
| 3,834,860 | 9/1974 | Fukuda | 432/106 |
| 3,864,075 | 2/1975 | Christiansen | 432/106 |

*Primary Examiner*—John J. Camby

*Attorney, Agent, or Firm*—Pennie & Edmonds

[57] ABSTRACT

A method of burning pulverous or granular material in a plant including a suspension preheater and a rotary kiln having an integrally mounted planetary cooler for cooling the burnt material exiting from the kiln by means of air subsequently used for combustion and preheating in the plant. The method comprises directing the heated cooling air from the planetary cooler into the rotary kiln, dividing the heated cooling air into two streams, directing the divided cooling air out of both ends of the kiln in its divided streams, directing at least one of the streams of the heated cooling air into the rotary kiln and utilizing the stream as combustion air in the rotary kiln, thereafter directing the stream as part of a waste gas out of one end of the kiln to the preheater for use in preheating the raw material fed into said preheater, drawing the other stream of heated cooling air out of the other end of the kiln and directing said other stream of cooling air to the suspension preheater for use in preheating raw material fed into said preheater. An apparatus for practicing the method of the invention is also disclosed.

15 Claims, 2 Drawing Figures

METHOD AND APPARATUS FOR BURNING PULVERULENT MATERIALS

BACKGROUND OF THE INVENTION

1. Field of the Invention

This invention relates to improvements in burning pulverous or granular materials. More particularly it pertains to such improvements as applied to burning cement raw meal to cement clinker.

2. Description of the Prior Art

Many plants for burning or sintering of ores, lime and cement raw materials have been developed in recent years and are of well known design. Frequently the suspension preheater consists of a number of cyclones through which the raw material is passed in succession from the inlet to the outlet of the preheater while exchanging heat with the waste gases from the rotary kiln passing in the opposite direction through the preheater to a dust precipitator. A typical example of such a dust precipitator is an electrostatic precipitator.

The cooler, which generally forms an integral part of the rotary kiln and thus rotates with the kiln, usually comprises a number of cooler tubes mounted in planetary fashion around the kiln. The material burnt in the rotary kiln is passed through chutes into the cooler tubes in which it is cooled by means of atmospheric air drawn through the cooler tubes in countercurrent flow to the hot material.

By the action of heat exchange in the planetary cooler between atmospheric air and the hot clinker the air is brought to a rather high temperature (of the order of 800° to 900°C) so that the heated cooling air has a high heat content which it is important to recover. This is preferably done by using the heated cooling air in the preheating and burning process, thereby improving the overall heat economy of the plant. However, it is not always possible to correlate the amount of cooling air needed to cool the burnt material to an acceptable temperature for handling after discharge from the cooler with the amount of combustion air necessary for the burning process performed in the rotary kiln.

In plants having stationary coolers such as grate coolers it is well known to use part of the heated cooling air in the preheater for recovering part of the heat. However, in planetary coolers associated with a rotary kiln it is a complicated matter to branch off part of the cooling air and still ensure sufficient cooling of the hot material. I have invented a method and plant for utilizing the heat of the preheated cooling air in such an improved manner as to improve the efficiency of such plants.

SUMMARY OF THE INVENTION

A method of burning pulverous or granular material in a plant including a suspension preheater and a rotary kiln having an integrally mounted planetary cooler for cooling the material exiting from the kiln by means of air subsequently used for combustion and preheating in the plant, comprising directing the heated cooling air from the planetary cooler into the rotary kiln, dividing the heated cooling air into two streams, and directing the divided cooling air out of both ends of the kiln in its divided streams. The method further comprises directing at least one stream of the heated cooling air into the rotary kiln and utilizing said stream as combustion air in the rotary kiln and thereafter directing said stream as part of a waste gas out of one end of the kiln to the preheater for use in preheating raw material fed into said preheater, drawing the other stream of heated cooling air out of the other end of the kiln, and directing said other stream of cooling air to the suspension preheater for use in preheating raw material fed into said preheater.

By dividing the heated cooling air in this manner whereby the kiln proper serves as distributor it becomes possible to use amounts of cooling air sufficient to cool the hot product in the planetary cooler without affecting the amount of combustion air to be used in the kiln in the burning process. The amount used for combustion is fairly constant, and is usually independent of the amount of cooling air required in the planetary cooler. In the known methods of burning it has more or less been a question of accepting a compromise. For example in some instances amounts of cooling air have been fixed in accordance with the requirements as to combustion air. This resulted in less cooling of the hot product. Alternately increasing the cooling air to cool the hot clinker sufficiently resulted in too much combustion air being accepted and passed through the kiln.

In burning methods in which only part of the burning is performed in the rotary kiln, it is particularly necessary to adjust the amounts of combustion air in order to carry out the burning in the most economical manner. Thus, the material may be partly burned by means of fuel introduced into the suspension preheater or part thereof. In particular, when burning cement raw material to cement clinker it may be advantageous to divide the process so that a preheating and at least partial calcination of the raw material is performed in the suspension preheater. The sintering process is then performed in the rotary kiln. In this case the amount of combustion air needed for the burning process in the rotary kiln proper will be limited and will be below the amount of heated cooling air resulting from the heat exchange process in the planetary cooler. Thus the excess of heated cooling air may be advantageously used together with the fuel in the preheating and calcining process in the suspension preheater.

The invention also relates to a rotary kiln plant for burning pulverous or granular material, the plant comprising a suspension preheater, a rotary kiln having an integral mounted planetary cooler which includes a plurality of cooler tubes mounted in planetary fashion about the kiln. Both ends of the rotary kiln are provided with ducts communicating with the suspension preheater. These ducts direct to the preheater both the waste gas from the combustion (or burning) in the kiln and part of the cooling air which has been heated by passage through the cooler. The preheater has a material discharge pipe communicating with one end of the rotary kiln for charging the kiln with the material preheated by the heated cooling air and the waste gas in the preheater. In this construction the heated cooling air is divided into two streams, one for combustion inside the rotary kiln and another which is discharged from the kiln without participating in the burning process inside the kiln. This allows the combustion air to be adjusted exactly to suit the burning process without affecting the cooling process in the planetary cooler. A correct division of the heated cooling air may thus be performed by means arranged outside the kiln, for instance by suitable dimensioning of the ducts and the exhaust fan or fans. With the use of a planetary cooler in this manner all the heated cooling air is used in the rotary kiln and in the suspension preheater in order to recover the heat contents of the air and gases as far as possible.

Furthermore, in a plant constructed according to the invention dust problems resulting from the spent cooling air exiting from the cooler are eliminated because all the air is used in the plant. This is contrary to the practice in a plant having a separate cooler in which part of the heated cooling air having a low heat content is normally discharged as waste air. In those plants it is usually necessary to install costly air cleaning equipment such as electrostatic precipitators, to correct the resulting dust problems.

In the present invention the suspension preheater preferably includes means for supplying additional fuel to a riser pipe or a stationary burning chamber forming part of the suspension preheater together with a part of the heated cooling air leaving the kiln, so that a partial burning of the material may be carried out. However it should be understood that such additional fuel is not necessary to the practice of the present invention.

The means for supplying additional fuel to the preheater may consist of a pipe connected to the riser pipe leading to a cyclone of the suspension preheater and forming the duct for the part of the heated cooling air which does not participate in the burning performed in the kiln. This cooling air however, is discharged from that end of the kiln where the cooler tubes are connected with their inlets for hot material. The supply means for fuel is preferably connected to the riser pipe together with the material discharge pipe discharging preheated raw material into the riser pipe in order to obtain a thorough mixing of material and fuel in the suspension. Thus calcining may be carried out in the riser pipe before the mixture is separated off by a separator of the suspension preheater. The material discharge of the separator is through a feed pipe connected to the material inlet end of the rotary kiln.

The ducts for waste gas and heated cooling air from the kiln may be joined at their inlets to the preheater so as to use both streams for heat exchange throughout the preheater. By connecting both ends of the rotary kiln to the suspension preheater of the plant the complicated installations for cleaning the air and the combustion gas become unnecessary. The entire excessive amount of heated cooling air may be directed in a simple manner to the suspension preheater. The proper division of the amounts of combustion gas and excess heated cooling air may be provided by choosing adequate cross-sections for the chutes and/or the outlet openings in the ends of the rotary kiln.

The plant may have a by-pass for discharge of a minor part of the waste gas from the waste gas duct. A by-pass of this kind may be arranged by means of a branch pipe from the waste gas duct near the connection to the kiln gas outlet so as to dispose continuously of part of the volatilized alkalies from the raw material to keep the circulation of these constituents in the plant at an adequately low level.

In an alternate embodiment of the invention, the suspension preheater may be comprised of separate halves, one of which is connected to the waste gas duct and the other of which is connected to the duct carrying the heated cooling air.

BRIEF DESCRIPTION OF THE DRAWINGS

Preferred embodiments of the invention are described hereinbelow with reference to the drawings wherein.

DETAILED DESCRIPTION OF THE PREFERRED EMBODIMENTS

Figure 1:
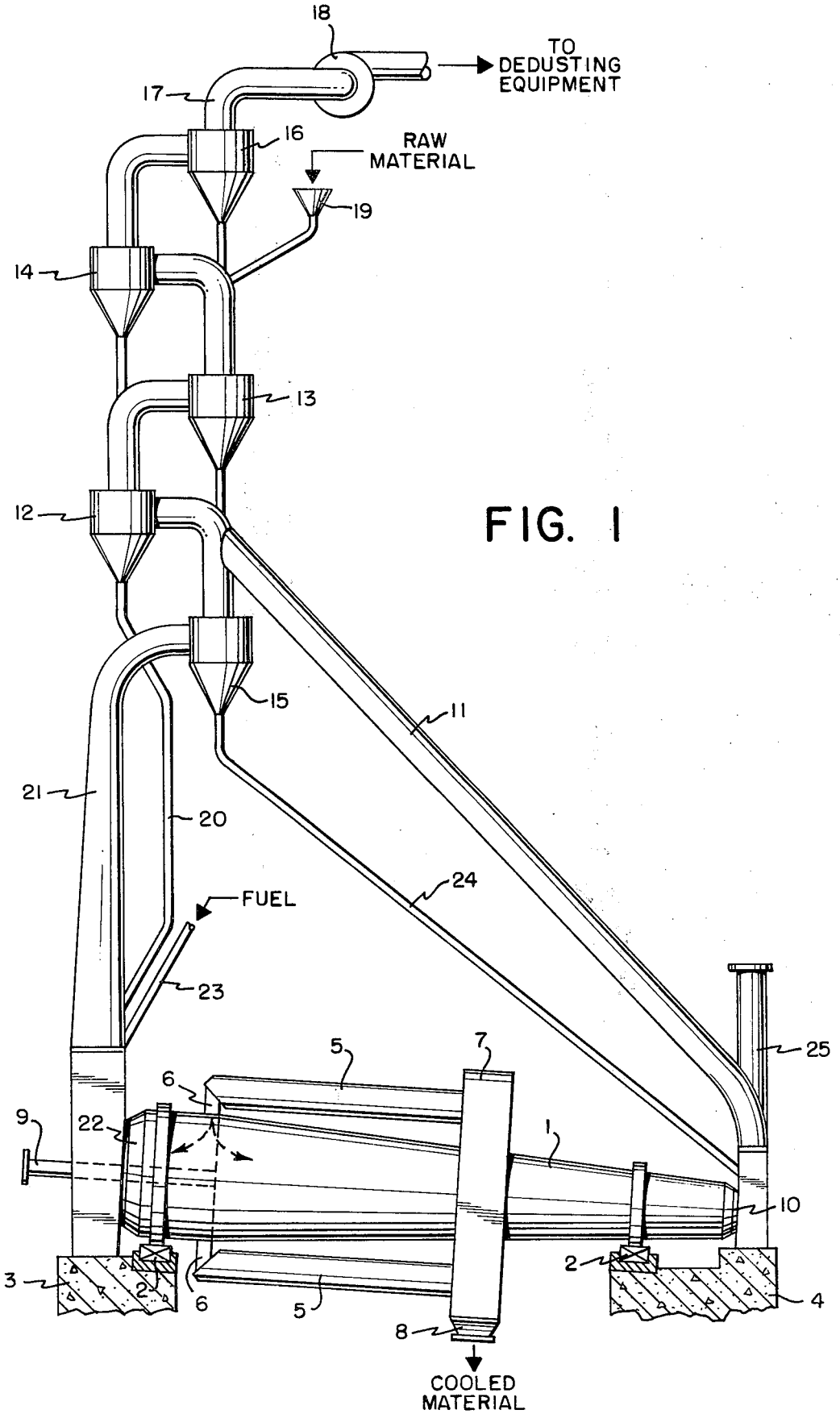
FIG. 1 is a side elevational view of a rotary kiln plant illustrating the principles of the present invention.

In FIG. 1 a rotary kiln 1 is shown mounted on roller bearings 2 supported by foundations 3 and 4. The rotary kiln 1 has an integrally mounted planetary cooler comprising a number of cooler tubes 5 communicating with the rotary kiln by means of chutes 6. The discharge ends of the cooler tubes are surrounded by a common casing 7, which is stationary and which has a bottom discharge 8 for the cooled material.

The rotary kiln has a burner arrangement 9 at one end and at the other end, a discharge port 10 (for the combustion gases) which is connected through a duct 11 to a suspension preheater comprising three heat exchange cyclones 12, 13 and 14 and two separator cyclones 15 and 16. The cyclone 16 has a gas outlet 17 with an exhaust fan 18, which leads to dedusting equipment which may be for example, an electrostatic precipitator. The suspension preheater has an inlet 19 for feeding raw material to the plant and a material outlet pipe 20 connected to a duct 21 which forms a communicating passage from the burner end 22 of the rotary kiln with the separator cyclone 15. The duct 21 has a fuel inlet pipe 23.

The separator cyclone 15 is provided with a material discharge pipe 24 communicating with the material inlet end 10 of the rotary kiln 1. The exhaust gas channel from the rotary kiln is provided with a by-pass 25 from duct 11 for by-passing minor amounts of the gas so as to control the contents of alkalies in the final product and in the gases, so that the formation of caking on the walls of the ducts and the cyclones is avoided as far as possible.

Raw material is fed to the plant through the inlet 19 and passes through the suspension preheater in a well known manner in a heat exchange process with the hot gases from the rotary kiln. In the example, the raw material contemplated is cement raw meal. The preheated raw material is discharged into the duct 21 from the cyclone 12 through the pipe 20. A suitable amount of fuel is supplied through the pipe 23 and the fuel and preheated raw material are carried as a mixture upwards in the duct 21 by heated air from the kiln outlet 22. During its passage through the duct the preheated raw material, the fuel, and the oxygen of the heated air participate in an approximately isothermal process in which the raw material is at least partially calcined. The mixture is separated off in the separator cyclone 15 and discharged through the feed pipe 24 into the kiln. A final burning or sintering is performed during the passage of the material through the kiln by means of the heat produced by the fuel from the burner arrangement 9. The hot product is discharged from the kiln through the chutes 6 communicating with the planetary cooler tubes 5.

The product passes through the cooler tubes 5 in countercurrent flow to cold atmospheric air passing from the casing 7 into the tubes. The cooled product collects in the bottom of the casing 7 and is discharged through the outlet 8.

The cooling atmospheric air drawn through the cooler tubes and preheated in the heat exchange process performed therein is passed into the rotary kiln 1 through the chutes 6. Inside the rotary kiln the heated cooling air is divided into two streams as indicated by the arrows. One stream passes up through the kiln as combustion air for the fuel delivered through the burner arrangement 9, and the other stream of heated cooling air passes directly out of the burner end of the kiln into the duct 21. Air is drawn through the plant by means of the exhaust fan 18 and the proper division of the two streams is obtained by careful choice and construction of the cross-sections of the various passages and ducts, etc.

In the example the rotary kiln shown is truncated and tapers toward the material inlet end to control the gas passage. This form of rotary kiln allows the use of an "up-hill" planetary cooler arranged slightly inclined so that material is transported from the inlet to the outlet under the effect of gravity.

By removing part of the heated cooling air from the rotary kiln only the amount of air necessary for the combustion is passed through the kiln so that the dimensions of the rotary kiln may be reduced. Clearly this reduces substantially the dust problems otherwise arising when great amounts of air or gas have to be passed through the kiln.

Furthermore, after passing out of the burner end of the kiln, the preheated cooling air may be passed to the preheater by simple means as shown, and the heat of the cooling air may be thus utilized in the calcining process in the riser pipe 20. Thus it can be seen that in riser pipe 21, the heated cooling air serves as combustion air.

Figure 2:
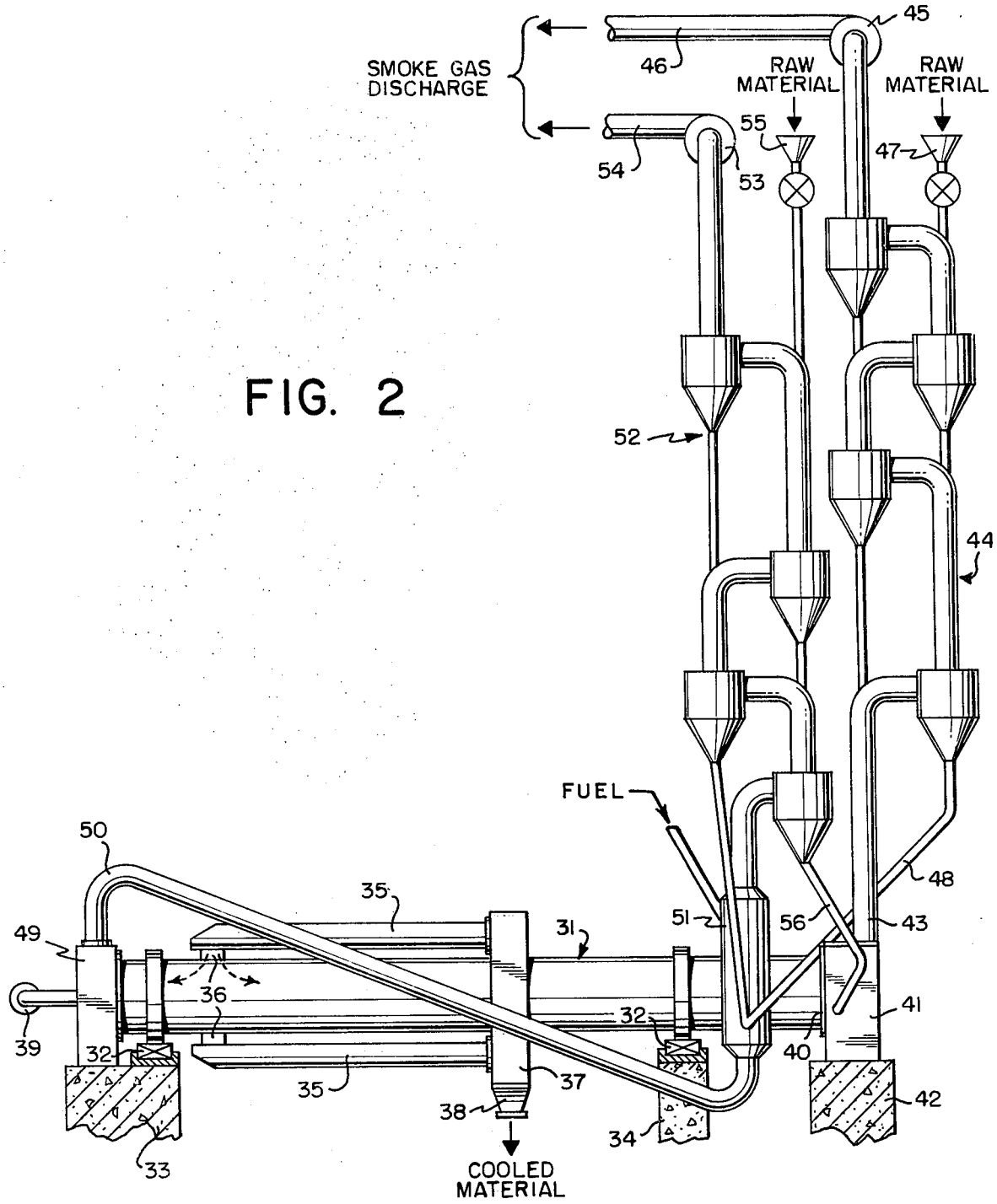
FIG. 2 is a side elevational view of an alternate embodiment of the rotary kiln plant of FIG. 1

FIG. 2 shows a rotary kiln 31 of a known type, mounted on roller bearings 32 supported by foundations 33 and 34. The rotary kiln 31 has an integrally mounted planetary cooler similar to the kiln illustrated in FIG. 1. The cooler comprises a number of cooler tubes 35 communicating with the rotary kiln 31 by means of chutes 36. The discharge ends of the cooler tubes extend towards the upper end of the rotary kiln 31 to form an uphill planetary cooler. The cooler is surrounded by a common casing 37 which is stationary and which has a bottom discharge 38 for the cooled material.

The rotary kiln 31 also has a burner arrangement 39 at its lower end and at the other end a discharge opening 40 for the discharge of the combustion gases into a conventional smoke gas chamber 41 supported on a foundation 42. The smoke gas outlet from the smoke gas chamber 41 is connected through a duct 43 to one half 44 of a suspension preheater having four separator cyclones as shown. The preheater 44 has a smoke gas fan 45 and a smoke gas discharge 46. Further it has an inlet 47 for the introduction of cold fine grained material and an outlet 48 for the preheated material.

The lower end of the rotary kiln 31 has a distribution chamber 49 for preheated cooling air, which chamber communicates, through a duct 50, with a stationary burning chamber 51 associated with the other half 52 of the suspension preheater. The other half 52 of the suspension preheater also has four separator cyclones and a smoke gas fan 53 and a smoke gas discharge 54. The suspension preheater 52 also has a material inlet 55 and outlet 56. Material from both preheater units 44 and 52 is discharged through these outlets 55 and 56 to the upper end of the rotary kiln 31 after having passed through the stationary burner chamber 51.

The plant of this embodiment operates in the same manner as the plant shown in FIG. 1. The cooling air to be used for cooling the hot product passes through the casing 37 into the cooler tubes in which it is preheated during heat exchange with the hot product. The preheated cooling air passes into the rotary kiln in which it is divided into two streams of preheated cooling air as shown by the arrows in FIG. 2. One stream is utilized as combustion air in the rotary kiln proper, and the other is utilized as combustion air in the stationary burning chamber 51.

The stream of preheated cooling air is divided by means of the fans 53 and 45 as soon as it has passed through the chutes 36 in such a manner that the fan 53 draws part of the heated cooling air out of the lower end of the rotary kiln and through the stationary burning chamber 51 while the fan 45 draws the remainder of the heated cooling air up through the rotary kiln and out of its upper end.

The control of the ratio between the two streams of preheated cooling air may be established by any suitable and well known means in connection with the fans 53 and 45.

I claim:

1. A method of burning pulverous or granular material in a plant including a suspension preheater and a rotary kiln having a burner means positioned at one end portion and having an integrally mounted planetary cooler having a series of cooler tubes for cooling the burnt material exiting from the kiln by means of air subsequently used for combustion and preheating in the plant, comprising directing the heated cooling air from the planetary cooler tubes into the rotary kiln, dividing said cooling air into two streams, at a location adjacent the burner end portion of the kiln, directing the divided cooling air out of both ends of the kiln in its divided streams, directing at least one stream of the heated cooling air comprising a portion of the total volume of heated cooling air into the rotary kiln and utilizing said stream as combustion air in the rotary kiln and thereafter directing said stream as part of a waste gas out of one end of the kiln to the preheater for use in preheating raw material fed into said preheater, drawing the other stream of heated cooling air out of the other end of the kiln and directing said other stream of cooling air to the suspension preheater for use in preheating raw material fed into said preheater.

2. The method according to claim 1 further comprising partially burning said preheated raw material in a stationary portion of said preheater prior to feeding said material into said kiln.

3. The method according to claim 2 further comprising partially burning said preheated raw material in at least one of a riser pipe and stationary burning chamber forming part of the preheater, feeding said other stream of air to said riser pipe or burning chamber to be utilized as combustion air for partially burning said preheated raw material, and feeding fuel to said riser pipe or burning chamber for partially burning said preheated raw material.

4. A method of burning pulverous or granular material in a plant including a suspension preheater which is divided into at least two preheater half-sections and a rotary kiln having a material inlet end portion and a material outlet end portion with a burner means positioned at the material outlet end portion and an integrally mounted planetary cooler comprising a plurality of cooler tubes for cooling the burnt material exiting from the kiln by means of air subsequently used for combustion and preheating in the plant, comprising directing the heated cooling air from the planetary cooler tubes into the rotary kiln, dividing said heated cooling air into two streams at a location adjacent the burner end portion, directing the divided cooling air out of both end portions of the kiln in its divided streams, directing at least one of said streams into the rotary kiln and utilizing said streams as combustion air in the rotary kiln and thereafter directing the waste gas from the combustion or burning in the kiln to at least one halfsection of the suspension preheater, directing the other stream of heated cooling air from the other end of the kiln to at least one of a riser pipe and stationary burning chamber forming a part of said other preheater half-section, supplying additional fuel to said riser pipe or stationary burning chamber such that together with said part of said heated cooling air, a partial burning of the preheated raw material fed to said other section of said suspension preheater is thereby carried out.

5. A rotary kiln plant for burning pulverous or granular material comprising a suspension preheater, a rotary kiln having a material inlet end portion and a material outlet end portion with a burner means positioned at the material outlet end portion and having an integral rotary cooler, the cooler including a plurality of cooler tubes mounted in planetary fashion about the kiln, means to direct the cooling air passing through the planetary cooler tubes into the kiln at a location adjacent the burner end portion so as to divide the cooling air into two streams directed to both end portions of the kiln, at least one duct means at each end portion of the rotary kiln communicating with the suspension preheater, one duct means directing the waste gas from the combustion or burning in the kiln from the waste gas outlet end portion of the kiln to the preheater, the other duct means directing part of the cooling air heated by passage through the cooler tubes to the preheater for preheating raw material, and a material discharge pipe extending from the material discharge end portion of the preheater and connected to the material inlet end portion of the kiln for charging the kiln with the material preheated in the preheater by the heated cooling air and kiln waste gas.

6. The rotary kiln plant according to claim 5 wherein the suspension preheater further comprises at least one of a riser pipe and stationary burning chamber forming at least part of said suspension preheater and said duct means from said rotary kiln communicating with said suspension preheater is adapted to direct a part of said heated cooling air to said riser pipe or burning chamber, and means for supplying additional fuel to said riser pipe or stationary burning chamber such that together with said part of said heated cooling air, a partial burning of the preheated raw material is carried out.

7. The rotary kiln plant according to claim 5 wherein said ducts for waste gas and heated cooling air are joined to said preheater such that both streams of heated cooling air are utilized for heat exchange in said preheater.

8. The rotary kiln plant according to claim 6 wherein said ducts for waste gas and heated cooling air are joined to said preheater such that both streams of heated cooling air are utilized for heat exchange in said preheater.

9. The rotary kiln plant according to claim 5 wherein the waste gas duct extending from said rotary kiln futher comprises a by-pass duct for discharging at least a part of said waste gas to prevent caking of the plant ducts due to excessive alkali content of the waste gases.

10. The rotary kiln plant according to claim 6 wherein the waste gas duct extending from said rotary kiln further comprises a by-pass duct for discharging at least a part of said waste gas to prevent caking of the plant ducts due to excessive alkali content of the waste gases.

11. The rotary kiln plant according to claim 7 wherein the waste gas duct extending from said rotary kiln further comprises a by-pass duct for discharging at least a part of said waste gas to prevent caking of the plant ducts due to excessive alkali content of the waste gases.

12. The rotary kiln plant according to claim 5 wherein said preheater comprises two separate sections, the duct extending from the waste gas outlet end portion of the kiln being connected to one half-section of the preheater and the duct for directing heated cooling air from the material outlet end portion of the kiln being connected to the other half-section of the preheater.

13. The rotary kiln plant according to claim 6 wherein said preheater comprises two separate sections, the duct extending from the waste gas outlet end portion of the kiln being connected to one half-section of the preheater and the duct for directing heated cooling air from the material outlet end portion of the kiln being connected to the other half-section of the preheater.

14. The rotary kiln plant according to claim 7 wherein said preheater comprises two separate sections, the duct extending from the waste gas outlet end portion of the kiln being connected to one half-section of the preheater and the duct for directing heated cooling air from the material outlet end portion of the kiln being connected to the other half-section of the preheater.

15. A rotary kiln plant for burning pulverous or granular material which comprises a suspension preheater divided into at least two preheater half-sections, a rotary kiln having a material inlet end portion and a material outlet end portion with a burner means positioned at the material outlet end portion of the rotary kiln and having an integral rotary cooler, the cooler including a plurality of cooler tubes mounted in planetary fashion about the kiln, means to direct the cooling air passing through the planetary cooler tubes into the kiln at a location adjacent the burner end portion so as to divide the cooling air into two streams directed to both end portions of the kiln, duct means at both end portions of the kiln communicating with the suspension preheater, one duct means positioned and adapted to direct the waste gas from the combustion or burning in the kiln from the gas outlet end of the kiln to one half-section of the preheater, the other duct being connected to at least one of a riser pipe and stationary burning chamber forming at least part of the other half-section of said suspension preheater, means for supplying additional fuel to said riser pipe or stationary burning chamber such that together with said part of said heated cooling air, a partial burning of the preheated raw material fed to said other section of said suspension preheater is thereby carried out.

* * * * *